United States Patent [19]

Jyoraku et al.

[11] Patent Number: 4,767,285

[45] Date of Patent: Aug. 30, 1988

[54] ELECTRIC BLOWER

[75] Inventors: Fumio Jyoraku; Hisanori Toyosima, both of Hitachi, Japan

[73] Assignee: Hitachi, Ltd., Tokyo, Japan

[21] Appl. No.: 37,844

[22] Filed: Apr. 13, 1987

[30] Foreign Application Priority Data

Apr. 14, 1986 [JP] Japan ..... 61-84139
Aug. 13, 1986 [JP] Japan ..... 61-188509

[51] Int. Cl.[4] ..... F04B 17/00

[52] U.S. Cl. ..... 417/366; 417/423 A; 415/119; 415/211

[58] Field of Search ..... 417/424 A, 424 R, 423 M, 417/423 T, 366, 423 A; 415/119, 208–211

[56] References Cited

U.S. PATENT DOCUMENTS 2,096,891 10/1937 Fredlund ..... 417/423 A
2,658,665 11/1953 Tschudy ..... 417/423 A
4,057,370 11/1977 Numata et al. ..... 417/366
4,111,615 9/1978 Watanabe ..... 417/366 X
4,679,990 7/1987 Yamaura et al. ..... 415/210 X

FOREIGN PATENT DOCUMENTS 2531323 3/1976 Fed. Rep. of Germany ..... 417/366
55-069797 5/1980 Japan ..... 417/366

*Primary Examiner*—Carlton R. Croyle
*Assistant Examiner*—Eugene L. Szczecina, Jr.
*Attorney, Agent, or Firm*—Antonelli, Terry & Wands

[57] ABSTRACT

An electric blower comprising an electric motor and an impeller drivingly rotated thereby. A housing and an end bracket connected thereto cooperate with each other to define an internal space within which the electric motor is disposed. A tubular wall surrounding an output shaft of the motor extends from an end wall of the end bracket into a central opening in a shroud plate of the impeller. A bearing is disposed between the tubular wall and the output shaft for rotatably supporting the output shaft. A guide vane assembly introduces air discharged from the impeller, into the internal space. The guide vane assembly is connected to the end bracket at a location radially outwardly remote from the bearing. The guide vane assembly guides the air flow from the impeller, toward openings in a peripheral wall of the end bracket.

21 Claims, 5 Drawing Sheets

ELECTRIC BLOWER

BACKGOUND OF THE INVENTION

The present invention relates to an electric blower for use in an electric cleaner, for example, An electric blower disclosed in Japanese Patent Application Laid-Open No. 55-69797 comprises a housing and an end bracket mounted on the housing and cooperating therewith to define an internal space. An output shaft of an electric motor arranged within the internal space extends out of the internal space through the end wall of the end bracket. The end wall of the end bracket has a cylindrical wall integrally formed therewith. The cylindrical wall surrounds the output shaft in concentric relation thereto. A bearing is arranged between the inner peripheral surface of the cylindrical wall and the output shaft to rotatably support the same.

An impeller is mounted on a portion of the output shaft extending out of the internal space, for rotation with the output shaft. Air flow discharged from the impeller is introduced into the internal space by a guide vane assembly. The guide vane assembly has a disc fitted on the outer peripheral surface of the cylindrical wall on the end wall of the end bracket. A plurality of diffuser vanes are arranged around the impeller and fixedly secured to the disc. A plurality of guide vanes are arranged around the cylindrical wall and are fixedly secured to the disc within a space between a shroud plate of the impeller and the end wall of the end bracket. The air discharged from the impeller and passing through the diffuser vanes and guide vanes flows into the internal space through openings formed in the end wall of the end bracket.

In the electric blower of the construction as described above, it is desired to shorten the overall dimension of the blower in the direction along the output shaft.

When the impeller is rotated by the electric motor, air in frictional contact with the surface of the shroud plate facing the disc is forced radially outwardly under the action of centrifugal force due to rotation of the shroud plate. Thus, a negative pressure is generated between the shroud plate and the disc. This negative pressure becomes higher and higher as the bearing is approached. The negative pressure generates a circulating flow of air from the internal space to the space between the shroud plate and the disc through the bearing. This tends to cause dust particles to adhere to the bearing. Further, this circulating flow tends to lower efficiency of the blower.

As described previously, the negative pressure generated between the shroud plate and the disc becomes higher and higher as the cylindrical wall is approached. The negative pressure generates a circulating flow through a fitted portion between the guide vane assembly and the end bracket.

OBJECTS AND SUMMARY OF THE INVENTION

An object of the present invention is to provide an electric blower wherein the entire length of the blower in the direction along the axis of the output shaft can be shortened.

Another object of the present invention is to provide an electric blower which can reduce the tendency of dust particles to adhere to the bearing.

A further object of the present invention is to provide an electric blower which can minimize circulating flow of air through a fitted portion between the end bracket and the guide vane assembly.

According to the present invention, there is provided an electric blower comprising:

a housing having axial one open end;

an end bracket having a peripheral wall and an end wall provided at axial one end of the peripheral wall, the end wall being provided therein with a central opening, the peripheral wall having the other axial end connected to the axial one open end of the housing, the end bracket cooperating with the housing to define an internal space;

an electric motor disposed within the internal space and including an output shaft having a portion thereof which extends out of the internal space through the central opening in the end wall of the end bracket;

an impeller including a shroud plate having formed therein a central opening, and a plurality of vanes arranged around the central opening in the shroud plate and fixed thereto, the portion of the output shaft extending through the central opening in the shroud plate;

mounting means for mounting the impeller on the portion of the output shaft extending out of the internal space, for rotation with the output shaft;

a tubular wall extending from the end wall of the end bracket into the central opening in the shroud plate, and surrounding the output shaft in concentric relation thereto; and bearing means disposed between an inner peripheral surface of the tubular wall and an outer peripheral surface of the output shaft, for rotatably supporting the output shaft.

According to the present invention, there is also provided an electric blower comprising;

a housing having axial one open end;

an end bracket having a peripheral wall and an end wall provided at axial one end of the peripheral wall, the end wall having formed therein a central opening, the periphral wall having the other axial end connected to the axial one open end of the housing, the end bracket cooperating with the housing to define an internal space;

an electric motor disposed within the internal space and including an output shaft extending out of the internal space through the central opening in the end wall of the end bracket;

an impeller mounted on a portion of the output shaft, which extends out of the internal space, for rotation with the output shaft;

bearing means mounted in the end wall of the end bracket for rotatably supporting the output shaft;

an end casing mounted on the end bracket to cover the impeller, the end casing having formed therein a suction port;

a plurality of openings formed in the peripheral wall of the end bracket; and guide vane means fixed relatively to the end bracket for guiding, when the impeller is rotated by the electric motor, air drawn by the impeller through the suction port in the end casing and discharged from the impellers, to the openings in the peripheral wall of the end bracket to allow the air to enter the internal space through the openings in the peripheral wall of the end bracket.

According to the invention, there is further provided an electric blower comprising:

a housing having axial one open end;

an end bracket having a peripheral wall and an end wall provided at axial one end of the peripheral wall, the end wall having formed therein a central opening, the peripheral wall having the other axial end connected to the axial one open end of the housing, the end bracket cooperating with the housing to define an internal space;

an electric motor disposed within the internal space and having an output shaft extending out of the internal space through the central opening in the end wall of the end bracket;

an impeller mounted on a portion of the output shaft extending out of the internal space, for rotation with the output shaft;

bearing means mounted in the end wall of the end bracket for rotatably supporting the output shaft; and guide vane means connected to the end bracket at a location radially outwardly remote from the bearing means, for guiding air discharged from the impeller into the internal space when the impeller is rotated by the electric motor.

DETAILED DESCRIPTION

Figure 1:
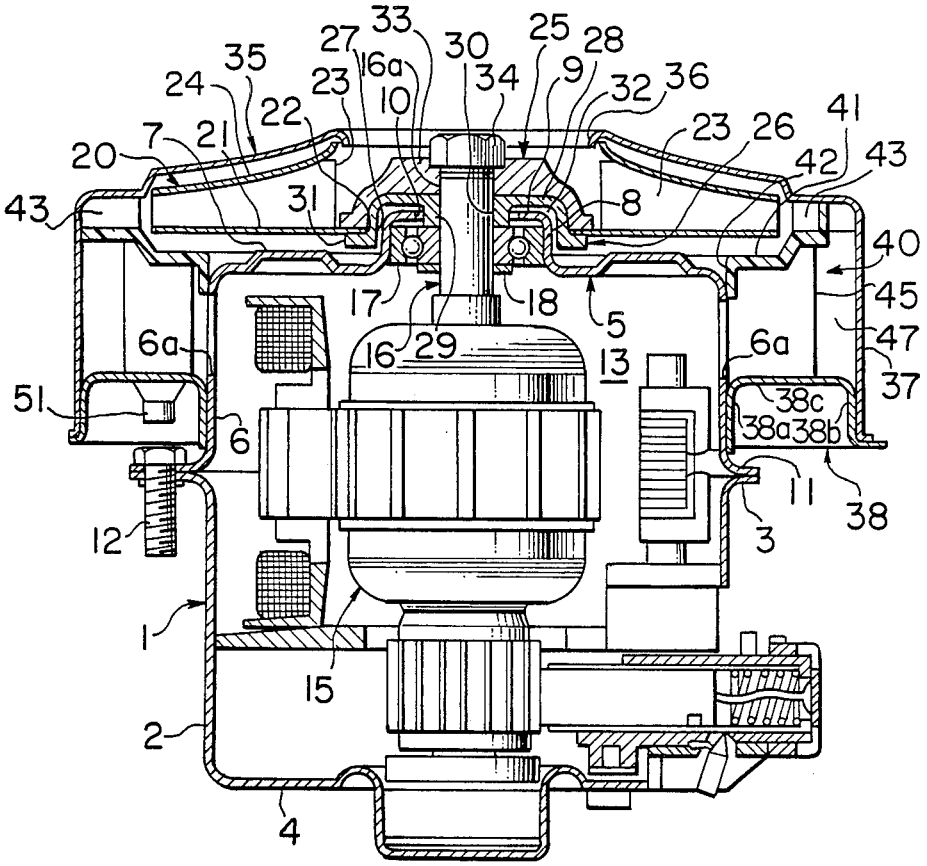
FIG. 1 is a longitudinal cross-sectional view showing an embodiment of an electric blower according to the present invention.

Referring to FIG. 1, an electric blower according to an embodiment of the present invention comprises a housing 1 which has a cylindrical peripheral wall 2. A flange 3 extends radially outwardly from axial one open end of the peripheral wall 2. An end wall 4 is provided at the other axial end of the peripheral wall 2.

An end bracket 5 has a tubular or cylindrical peripheral wall 6 formed with a plurality of substantially rectangular openings 6*a*. An end wall 7 is provided at axial one end of the peripheral wall 6. A tubular or cylindrical wall 8 extends from the end wall 6 away from the housing 1. A bottom wall 9 is provided at one axial end of the cylindrical wall 8 remote from the housing 1. A central opening 10 is formed in the bottom wall 9. The peripheral wall 6, the end wall 7, the cylindrical wall 8 and the bottom wall 9 are integrally formed by a press working of steel plates. A flange 11 integral with the peripheral wall 6 extends radially outwardly from the other axial end. The flange 11 is connected to the flange 3 of the housing 1 by bolts 12. The end bracket 5 cooperates with the housing 1 to define an internal space 13.

An electric motor 15 is arranged within the internal space 13. An output shaft 16 of the motor 15 has a portion 16*a* extending out of the internal space 13 through the central opening 10 in the bottom wall 9 of the end bracket 5. The cylindrical wall 8 of the end bracket 5 surrounds the output shaft 16 in concentric relation thereto. A ball bearing 17 is arranged between the inner peripheral surface of the cylindrical wall 8 and the outer peripheral surface of the output shaft 16 for rotatably supporting the same. A retainer ring 18 retains the bearing 17 in position.

An impeller 20 has a shroud plate 21 formed with a central opening 22. A plurality of vanes 23 are arranged aound the central opening 22 in the shroud plate 21 in equidistantly spaced relation to each other and are fixedly secured to the shroud plate 21 and an end plate 24. The portion 16*a* of the output shaft 16 extends through the central opening 22 in the shroud plate 21. The cylindrical wall 8 of the end bracket 5 extends into the central opening 22 in the shroud plate 21.

A mount assembly 25 mounts the impeller 20 on the portion 16*a* of the output shaft 16 for rotation therewith. A support member 26 has a cylindrical peripheral wall 27 which is fitted in the central opening 22 in the shroud plate 21 of the impeller 20. An end wall 28 is provided at one axial end of the peripheral wall 27 in an integral manner. The end wall 28 is provided with a central projection 29 and with a central bore 30 through which the output shaft 16 extends. A free end surface of the central projection 29 abuts against the inner race of the bearing 17. A flange 31 extends radially outwardly from the other axial end of the peripheral wall 27. The peripheral wall 27 and the end wall 28 form a circular recess 32 which opens toward the internal space 13. A portion of the cylindrical wall 8 of the end bracket 5 and the bottom wall 9 are received within the recess 32. A retainer member 33 fitted on the portion 16*a* of the output shaft 16 retains the impeller 20 with the shroud plate 21 being clamped between the peripheral portion of the retainer member 33 and one end face of the flange 31. A nut 34 threadedly engaging with the free end of the output shaft 16 urges the retainer member 33 against the support member 26 so as to fixedly mount the retainer member 33 and the support member 26 on the output shaft 16 for rotation therewith.

Figure 2:
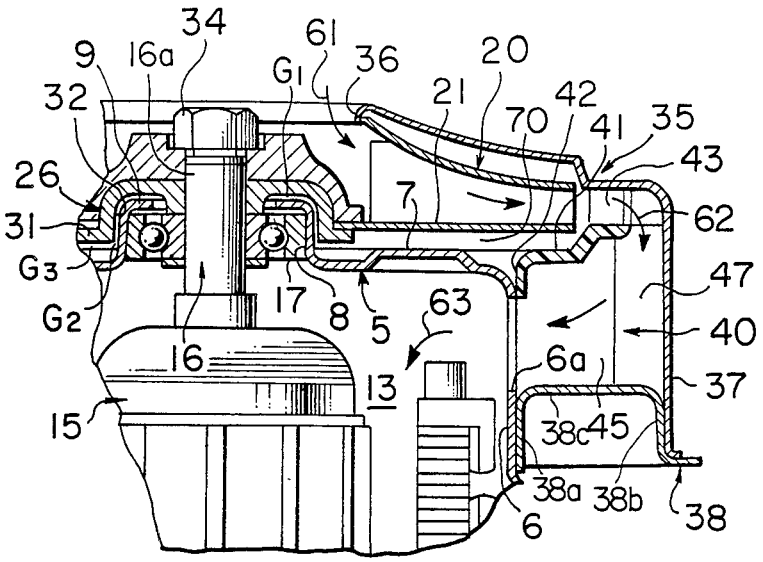
FIG. 2 is an enlarged, cross-sectional fragmental view showing a bearing incorporated in the electric blower shown in FIG. 1.

As clearly shown in FIG. 2, the cylindrical wall 8 and the bottom wall 9 of the end bracket 5 are received within the recess 32. The bottom wall 9 cooperates with the bottom surface of the recess 32 to define a slight gap $G_1$ therebetween. The gap $G_1$ communicates with the internal space 13 through the bearing 17. The cylindrical wall 8 cooperates with the peripheral surface of the recess 32 to define a slight gap $G_2$ therebetween. The gap $G_2$ communicates with the gap $G_1$. The other end face of the flange 31 of the supporting member 26 cooperates with the end wall 7 of the end bracket 5 to define a slight gap $G_3$ therebetween. The gap $G_3$ communicates with the gap $G_2$. Thus, the annular space between the end wall 7 of the end bracket 5 and the shroud plate 21 of the impeller 20 communicates with the internal space 13 through the gaps $G_3$, $G_2$ and $G_1$ which extend over a relatively long distance.

An end casing 35 having formed therein a suction opening 36 has a peripheral wall 37 force-fitted on an annular mount 38 which is fixedly secured to the peripheral wall 6 of the end bracket 5, so as to cover the impeller 20. The annular mount 38 comprises an inner cylindrical wall 38*a* secured to the peripheral wall 6 of the end bracket 5, an outer cylindrical wall 38*b* on which the peripheral wall 37 of the end casing 35 is fitted, and a radial wall 38*c* extending between the inner and outer walls 38*a* and 38*b* to integrally connect them to each other. The inner and outer cylindrical walls 38*a* and 38*b* are in concentric relation to each other. The radial wall 38*c* has an inner surface which is substantially flush with axial sides of the respective rectangular openings 6*a* in the peripheral wall of the end bracket 5, which axial sides are remote from the impeller 20.

A guide vane assembly 40 which is an integrally molded part of a resin is fixed relatively to the end bracket 5 for introducing air discharged from the impeller 20 to the openings 6*a* in the peripheral wall 6 of the end bracket 5 when the impeller 20 is rotated by the electric motor 15, permitting the air to flow into the internal space 13 through the openings 6*a*. The guide vane assembly 40 has an annular disc 41. A cylindrical wall 42 extends axially from the inner peripheral edge of the disc 41 in an integral manner. The cylindrical wall 42 is connected to the end bracket 5 at a position radially outwardly remote from the bearing 17. In the case of the illustrated embodiment, the cylindrical wall 42 is sealingly force-fitted onto the peripheral wall 6 of the end bracket 5.

Figure 3:
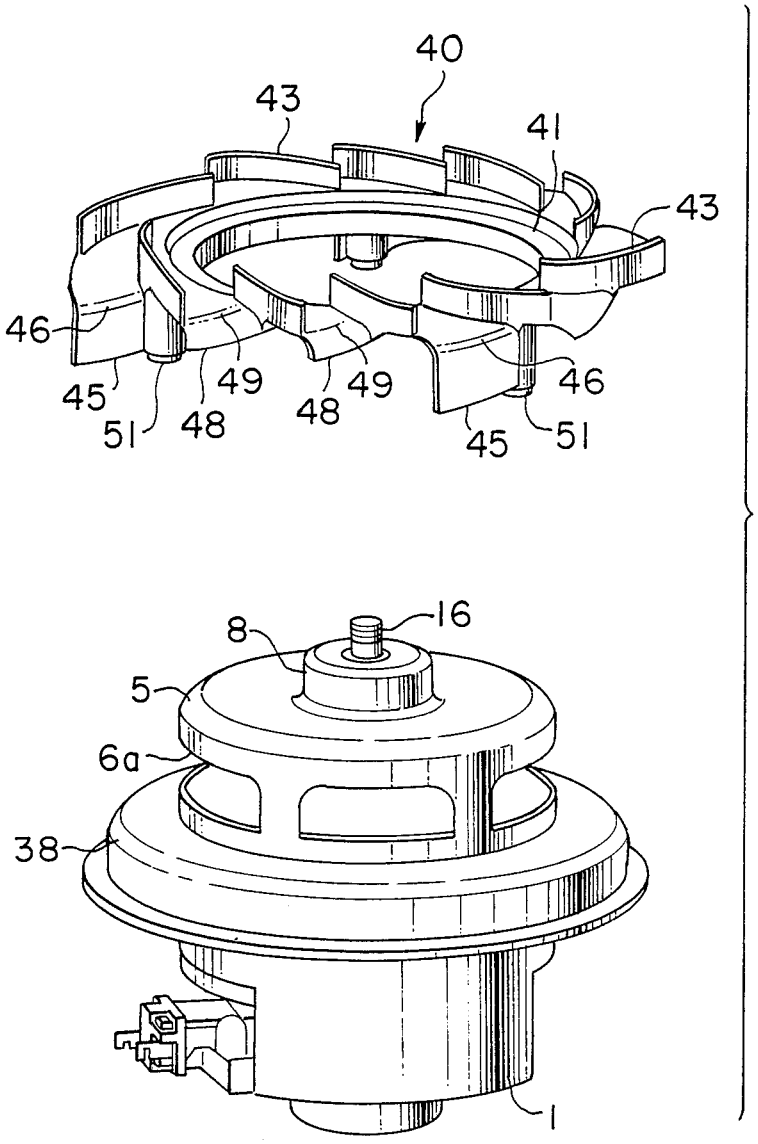
FIG. 3 is a perspective view showing a guide vane assembly removed from the end bracket shown in FIG. 1.

As clearly shown in FIG. 3, a plurality of diffuser vanes 43 are arranged in equidistantly spaced relation to each other around the impeller 20 and are integrally secured to the outer peripheral edge portion of one end face of the disc 41. A diffuser flow passage is defined by each pair of adjacent diffuser vanes 43.

Figure 4:
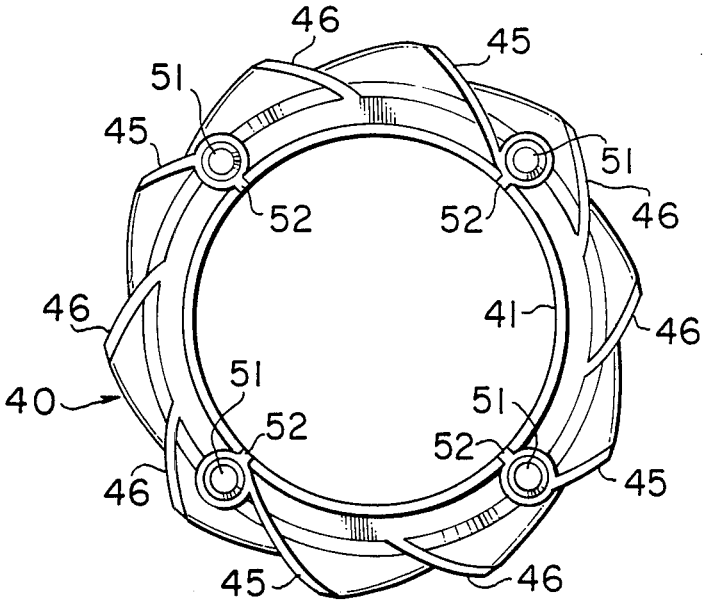
FIG. 4 is a bottom plan view of the guide vane assembly shown in FIG. 3.

As shown clearly in FIGS. 3 and 4, a plurality of guide vanes 45 are provided, with one associated with each of the openings 6*a* in the peripheral wall 6 of the end bracket 5. Each guide vane 45 has a lower edge abutting against the inner face of the radial wall 38*c* of the annular mount 38 and extends between the peripheral wall 6 of the end bracket 5 and the peripheral wall 37 of the end casing 35. The upper edge of each guide vane 45 is integrally connected to the disc 41, and is joined at 46 smoothly to the diffuser flow passage between a corresponding pair of diffuser vanes 43. The adjacent guide vanes 45 of each pair define a flow passage 47 therebetween (FIGS. 1 and 2), and the flow passage 47 communicates with a corresponding one of the openings 6*a*. As will be seen from FIG. 3, the guide vanes 48 having the height lower than that of the guide vanes 45 are smoothly joined at 49 respectively to the diffuser flow passages between the diffuser vanes 43 located between the adjacent guide vanes 45.

The number of the diffuser vanes 43 is determined depending upon the aerodynamic performance and noise, and is selected independently of the number of the guide vanes 45 which corresponds to that of the openings 6*a* in the peripheral wall 6 of the end bracket 5. Therefore, the number of the diffuser vanes 43 is not necessarily the number of the guide vanes 45 and multiplied by integer. However, the difference in the conditions of the respective air flows from the flow passages between the guide vanes 48 with respect to the openings 6*a* can be substantially neglected, because the flow passages between the guide vanes 48 join the respective flow passage 47, even though an unequal number of guide vanes 48 is arranged between the guide vanes 45.

As shown in FIGS. 3 and 4, a plurality of positioning bosses 51 extend from the disc 41 toward the annular mount 38. The bosses 51 are fitted respectively into positioning bores (not shown) formed in the annular mount 38 as shown in FIG. 1 so as to position the guide vane assembly 40 with respect to the annular mount 38. A rib 52 extending along each boss 51 (FIG. 4) is brought into intimate contact with the peripheral wall 6 of the end bracket 5 thereby minimizing leakage of air between the adjacent flow passages 47.

The height of the guide vane 45 as measured along the axis of the output shaft 16 is at least 1.5 times, preferably about 2–3 times that of the diffuser vanes 43 as measured in the similar manner.

Figure 5:
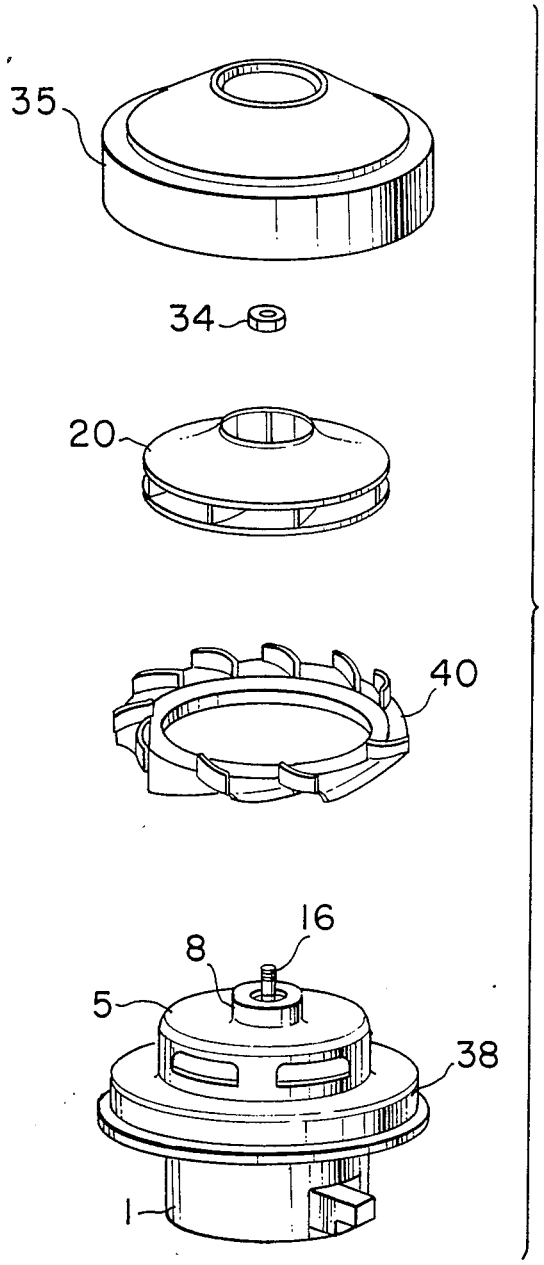
FIG. 5 is an exploded perspective view of the electric blower shown in FIG. 1.
Figure 6:
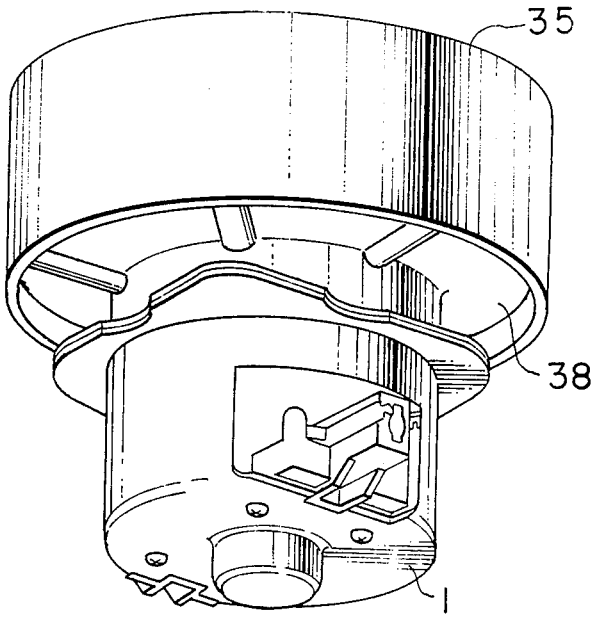
FIG. 6 is a perspective view showing the appearance of the electric blower shown in FIG. 1.

Now, the manner of assembling of the electric blower of the above construction will be described below with reference to FIG. 5. The end bracket 5 to which the annular mount 38 is fixedly secured is fixedly mounted on the housing 1 by the bolts 12 (FIG. 1). Subsequently, the guide vane assembly 40 is fitted on the end bracket 5. Then, the impeller 20 is mounted on the cylindrical wall 8 of the end bracket 5. Thereafter, the nut 34 is threadedly engaged with the free end of the output shaft 16 to fixedly secure the impeller 20 to the output shaft 16. Finally, the end casing 35 is fitted on the annular mount 38. Thus, the electric blower is assembled as shown in FIG. 6.

The operation of the electric blower constructed as described above will now be described with reference to FIGS. 2 and 3.

When electric current is supplied to the motor 15, the output shaft 16 is rotated thereby rotating the impeller 20. The rotating impeller 20 draws air through the suction opening 36 in the end casing 35 as indicated by the arrow 61. The thus drawn air is pressurized by the impeller 20 and is discharged therefrom. The dynamic pressure of the air flow discharged from the impeller 20 is converted into a static pressure by the diffuser vanes 43. The air flow having the pressure thus converted into the static pressure changes its course at the joined portions 46 shown in FIG. 3 and is introduced into the flow passages 47 between the guide vanes 45 as indicated by the arrow 62 in FIG. 2. The air flows from the respective diffuser flow passages between the diffuser vanes 43 associated with the guide vanes 48 which have the smaller height are introduced into the flow passages 47 having the greater cross sectional area and are jointed to each other, thereby permitting the draft power loss to be reduced. To this end, the guide vanes 45 have a height at least 1.5 times that of the guide vanes 48.

The air flow introduced into the flow passages 47 is guided by the guide vanes 45 and enters the internal space 13 through the openings 6*a* as indicated by the arrow 63. The air flow introduced into the internal space 13 cools the motor 15 and, thereafter, is discharged from the internal space 13 through openings (not shown) formed in the housing 1.

As the impeller 20 rotates, air in a space 70 between the end wall 7 of the end bracket 5 and the shroud plate 21 of the impeller 20 is urged to flow radially outwardly under the action of centrifugal force due to frictional contact thereof with the rotating shroud plate 21, to thereby generate a negative pressure within the space 70. The negative pressure becomes higher and higher as the center of rotation of the shroud plate 21 is approached. On the other hand, the flow passages 47 and the internal space 13 into which the air from the impeller 20 is introduced are held at a positive pressure. Therefore, a pressure difference is caused to occur between the space 70, and the flow passages 47 and the internal space 13 so that the air tends to be recirculated from the internal space 13 to the space 70 through the bearing 17. However, the amount of the air tending to be recirculated from the internal space 13 to the space 70 through the bearing 17 is minimized by virtue of the gaps $G_1$, $G_2$ and $G_3$ each having the small size and extending over a relatively long distance. Thus, the effficiency of the blower can be enhanced. The minimization of the amount of air tending to be recirculated enables dust particles tending to adhere to the bearing 17 to be minimized thereby making it possible to prolong the service life of the bearing 17.

The pressure difference between the flow passages 47 and the space 70 tends to cause recirculation flow of air from the flow passages 47 to the space 70 through the fitted portion of the peripheral wall 6 of the end bracket 5 and the cylindrical wall 42 of the guide vane assembly 40. However, the pressure difference is considerably lower as compared with the pressure difference at the position near the bearing 17. Therefore, it is not necessary to pay severe attention to the sealing of the fitted portion described above. In other words, mere fitting between the peripheral wall 6 and the cylindrical wall 42 enables the minimization of the amount of recirculating air through the fitted portion. Of course, the amount of the recirculating air can be further reduced by force-fitting the cylindrical wall 42 onto the peripheral wall 6, or by bonding them together by a bonding agent, thereby enhancing the efficiency.

Figure 7:
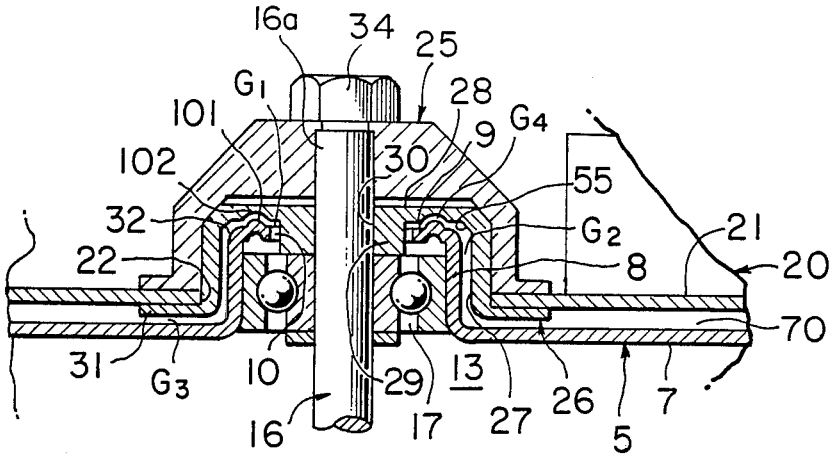
FIG. 7 is an enlarged, cross-sectional fragmental view showing a modification of the electric blower shown in FIG. 1.

FIG. 7 shows a modification of the electric blower shown in FIGS. 1 through 6. In FIG. 7, like reference numerals are used to designate parts and components similar to those shown FIGS. 1 through 6, and the description of these parts and components will therefore be omitted.

An annular projection 101 is formed in the bottom wall 9 of the end bracket 5 so as to project from the bottom wall 9 toward the bottom surface of the circular recess 32 in the support member 26. An annular recess 102 in which the annular projection 101 is received with a slight gap $G_4$ left therebetween is formed in the bottom surface of the circular recess 32. Thus, the gap $G_4$ cooperates with the gaps $G_1$, $G_2$ and $G_3$ to form a labyrinth seal thereby further minimizing the amount of air recirculated from the internal space 13 to the space 70 through the bearing 17.

In the modification shown in FIG. 7, the projection 101 may be formed in the bottom surface of the circular recess 32 while the recess 102 may be formed in the bottom wall 9. Alternatively, one of the projection 101 and the recess 102 may be formed in the outer peripheral surface of the cylindrical wall 8, while the other may be formed in the peripheral surface of the circular recess 32. In an alternative embodiment more than one projection 101 may be provided and, a similar number of recesses 102 on the other part to cooperate with the projections.

In the electric blower as described in connection with FIGS. 1 through 7, the bearing 17 received in the cylindrical wall 8 of the end bracket 5 extends into the central opening 22 in the shroud plate 21 of the impeller 20. The entire length of the blower along the axis of the output shaft 16 can be shortened accordingly. Further, the flow passages 47 are formed between the peripheral wall 6 of the end bracket 5 and the peripheral wall of the end casing 35 and are brought into communication with the openings **6*a* formed in the peripheral wall 6 of the end bracket 5**. This makes it possible to further shorten the entire length of the blower.

By the provision of the gaps $G_1$, $G_2$ and $G_3$ or $G_1$, $G_2$, $G_3$ and $G_4$ each having a small size and extending over a relatively long distance, the amount of air recirculated from the internal space 13 to the space 70 through the bearing 17 is minimized. Thus, dust particles tending to adhere to the bearing 17 can be reduced so that the service life of the bearing 17 can be prolonged.

The guide vane assembly 40 is connected to the end bracket 5 at a position radially outwardly remote from the bearing 17, i.e., the cylindrical wall 42 of the guide vane assembly 40 is fitted on the perpheral wall 6 of the end bracket 5. Since the fitted portion between the cylindrical wall 42 and the peripheral wall 6 is spaced radially outwardly remote from the bearing 17, the pressure difference across the fitted portion is low. Therefore, the amount of the circulating air passing through the fitted portion is small thereby rendering the sealing at the engaging portions easy. In other words, mere fitting of the cylindrical wall 42 onto the peripheral wall 6 results in sufficient sealing of the fitted portion. This makes the assembling of the blower easy. Since the radial length of the disc 41 of the guide vane assembly 40 integrally molded from resin can be shortened, risk can be minimized that the disc 41 is deformed due to the heat from the motor 15 and is brought into contact with the shroud plate 21 of the impeller 20.

The cylindrical wall 8 of the end bracket 5 and the peripheral wall 27 of the supporting member 26 are in coaxial relation to each other with respect to the axis of the output shaft 16. Thus, it is made easy to render the size of the gap $G_2$ uniform.

What is claimed is:

1. An electric blower comprising:

a housing having axial one open end;

an end bracket having a peripheral wall and an end wall provided at axial one end of the peripheral wall, said end wall being provided therein with a central opening, said peripheral wall having the other axial end connected to the axial one open end of said housing, said end bracket cooperating with said housing to define an internal space;

an electric motor disposed within said internal space and including an output shaft having a portion thereof which extends out of said internal space through the central opening in the end wall of said end bracket;

an impeller including a shroud plate having formed therein a central opening, and a plurality of vanes arranged around the central opening in said shroud plate and fixed thereto, said portion of said output shaft extending through the central opening in said shroud plate;

mounting means for mounting said impeller on said portion of said output shaft extending out of said internal space, for rotation with said output shaft, wherein said mounting means is associated with the central opening in said shroud plate of said impeller, and has a recess which opens toward said internal space;

a tubular wall extending from the end wall of said end bracket into the central opening from the end wall of said end bracket into the central opening in said shroud plate, and surrounding said output shaft in concentric relation thereto; said tubular wall being received in said recess and having an outer peripheral surface cooperating with a peripheral surface of said recess to define a slight gap therebetween; and bearing means disposed between an inner peripheral surface of said tubular wall and an outer peripheral surface of said output shaft, for rotatably supporting said output shaft.

2. An electric blower as defined in claim 1, wherein:

a bottom wall is provided at an axial end of said tubular wall which is remote from said internal space, said bottom wall having formed therein a central opening through which said output shaft extends, said bottom wall cooperating with a bottom surface of said recess of said mounting means to constitute at least part of said gap therebetween.

3. An electric blower as defined in claim 2, wherein said mounting means comprises a support member having a peripheral wall fitted in the central opening in said shroud plate of said impeller, an end wall provided at an axial end of the peripheral wall of said support member, and a flange extending radially outwardly from the other axial end of the peripheral wall of said support member, the end wall of said support member having therein a central bore through which said output shaft extends, the peripheral and end walls of said support member forming said recess, said flange having one end face thereof cooperating with the end wall of said end bracket to define the slight gap therebetween, said mounting means further comprising a retainer member, said shroud plate being clamped between said retainer member and the other end face of said flange, and means for fixedly securing said retainer member to said output shaft.

4. An electric blower as defined in claim 1, wherein said tubular wall is integral with the end wall of said end bracket.

5. An electric blower as defined in claim 2, wherein said tubular wall is integral with the end wall of said end bracket, and said bottom wall is integral with, said tubular wall.

6. An electric blower as defined in claim 2, including:

at least one annular projection provided on one of at least one of said tubular wall and said bottom wall and at least one of the peripheral and bottom surfaces of said recess; and at least one annular groove, said annular projection being received in said annular groove with a slight gap left therebetween, said annular groove being provided in the other of at least one of said tubular wall and said bottom wall and at least one of the peripheral and bottom surfaces of said recess.

7. An electric blower comprising:

a housing having an axial open end;

an end bracket having a peripheral wall and an end wall provided at an axial end of said peripheral wall, said end wall having formed therein a central opening, said peripheral wall having the other axial end connected to the axial open end of said housing, said end bracket cooperating with said housing to define an internal space;

an electric motor disposed within said internal space and including an output shaft extending out of said internal space through the central opening in said end wall of said end bracket;

an impeller mounted on a portion of said output shaft which extends out of said internal space for rotation with said output shaft;

bearing means mounted in the end wall of said end bracket for rotatably supporting said output shaft;

an end casing mounted on said end bracket to cover said impeller, said end casing having formed therein a suction port;

a plurality of openings formed in the peripheral wall of said end bracket; and guide vane means fixed relatively to said end bracket for guiding, when said impeller is rotated by said electric motor, air drawn by said impeller through said suction port in said end casing and discharged from said impeller, to said openings in the peripheral wall of said end bracket to allow the air to enter said internal space through said openings in the peripheral wall of said end bracket.

8. An electric blower as defined in claim 7, wherein said end casing has a peripheral wall located radially outwardly of the peripheral wall of said end bracket, and said guide vane means comprises a plurality of diffuser vanes disposed around said impeller and a plurality of guide vanes disposed between the peripheral wall of said end bracket and the peripheral wall of said end casing for guiding the air flow from said diffuser vanes to the openings in said peripheral wall of said end bracket.

9. An electric blower as defined in claim 8, including:

an annular mount through which the peripheral wall of said end casing is mounted to the peripheral wall of said end bracket, said annular mount having a radial wall extending between the peripheral wall of said end casing and the peripheral wall of said end bracket;

said guide vanes having their respective edges remote from said impeller and which abut against an inner surface of said radial wall; and said openings in said peripheral wall of said end bracket being generally rectangular in shape, said openings in said peripheral wall of said end bracket having their respective axial sides which are remote from said impeller and which are substantially flush with the inner surface of said radial wall.

10. An electric blower as defined in claim 8, wherein said guide vanes have a height as measured along said output shaft, which is at least 1.5 times that of said diffuser vanes as measured along said output shaft.

11. An electric blower as defined in claim 7, including:

said impeller comprising a shroud plate having formed therein a central opening, and a plurality of vanes arranged around the central opening in said shroud plate and fixedly secured thereto, said portion of said output shaft extending through the central opening in said shroud plate;

mounting means for mounting said impeller to said portion of said output shaft, for rotation with said output shaft;

a tubular wall extending from the end wall of said end bracket into the central opening in said shroud plate, and surrounding said output shaft in concentric relation thereto; and said bearing means being disposed between an inner peripheral surface of said tubular wall and an outer peripheral surface of said output shaft.

12. An electric blower as defined in claim 11, including:

said mounting means being associated with the central opening in said shroud plate of said impeller, and having a recess which opens toward said internal space, said tubular wall being received in said recess and having an outer peripheral surface cooperating with a peripheral surface of said recess to define a slight gap therebetween;

a bottom wall provided at an axial end of said tubular wall which is remote from said internal space, said bottom wall having formed therein a central opening through which said output shaft extends, said bottom wall cooperating with a bottom surface of said recess of said mounting means to define a slight gap therebetween; and said mounting means comprising a support member having a perpheral wall fitted in the central opening in said shroud plate of said impeller, an end wall provided at an axial end of the peripheral wall of said support member, and a flange extending radially outwardly from the other axial end of the peripheral wall of said support member, the end wall of said support member having therein a central bore through which said output shaft extends, the peripheral and end walls of said support member forming said recess, said flange having one end face thereof cooperating with the end wall of said end bracket to define a slight gap therebetween, said mounting means further comprising a retainer member, said shroud plate being clamped between said retainer member and the other end face of said flange, and means for fixedly securing said retainer member to said output shaft.

13. An electric blower comprising:

a housing having axial one open end;

an end bracket having a peripheral wall with openings and an end wall provided at axial one end of said peripheral wall, said end wall having formed therein a central opening, said peripheral wall having the other axial end connected to the axial one open end of said housing, said end bracket cooperating with said housing to define an internal space;

an electric motor disposed within said internal space and having an output shaft extending out of said internal space through the central opening in said end wall of said end bracket;

an impeller mounted on a portion of said output shaft extending out of said internal space, for rotation with said output shaft;

bearing means mounted in the end wall of said end bracket for rotatably supporting said output shaft; and guide vane means connected to said end bracket at a location radially outwardly remote from said bearing means, for guiding air discharged from said impeller thorugh said openings into said internal space when said impeller is rotated by said electric motor.

14. An electric blower as defined in claim 13, including:

an end casing mounted to said end bracket to cover said impeller, said end casing having formed therein a suction port; and said guide vane means guiding, when said impeller is rotated by said electric motor, air drawn through said suction port in said end casing and discharged from said impeller, to said openings in the peripheral wall of said end bracket to allow the air to enter said internal space through said openings in the peripheral wall of said end bracket.

15. An electric blower as defined in claim 14, wherein said guide vane means is fitted on the peripheral wall of said end bracket.

16. An electric blower as defined in claim 14, wherein said guide vane means is force-fitted on the peripheral wall of said end bracket.

17. An electric blower as defined in claim 13, including:

said impeller including a shroud plate having formed therein a central opening, and a plurality of vanes arranged around the central opening in said shroud plate and fixed thereto, said portion of said output shaft extending through the central opening in said shroud plate;

mounting means for mounting said impeller on said portion of said output shaft extending out of said internal space, for rotation with said output shaft;

tubular wall extending from the end wall of said end bracket into the central opening in said shroud plate, and surrounding said output shaft in concentric relation thereto; and said bearing means being disposed between an inner peripheral surface of said tubular wall and an outer peripheral surface of said output shaft;

said mounting means being associated with the central opening in said shroud plate of said impeller, and having a recess which opens toward said internal space, said tubular wall being received in said recess and having an outer peripheral surface cooperating with a peripheral surface of said recess to define a slight gap theretween;

a bottom wall provided at axial one end of said tubular wall which is remote from said internal space, said bottom wall having formed therein a central opening through which said output shaft extends, said bottom wall cooperating with a bottom surface of said recess of said mounting means to define a slight gap therebetween; and said mounting means comprising a support member having a peripheral wall fitted in the central opening in said shroud plate of said impeller, an end wall provided at axial one end of the peripheral wall of said support member, and a flange extending radially outwardly from the other axial end of the peripheral wall of said support member, the end wall of said support member having a central bore through which said output shaft extends, the peripheral and end walls of said support member forming said recess, said flange having one end face thereof cooperating with the end wall of said end bracket to define a slight gap therebetween, said mounting means further comprising a retainer member, said shroud plate being clamped between said retainer member and the other end face of said flange, and means for fixedly securing said retainer member to said output shaft.

18. An electric blower as defined in claim 14, including:

said end casing having a peripheral wall located radially outwardly of the peripheral wall of said end bracket, and said guide vane means comprising a plurality of diffuser vanes disposed around said impeller and a plurality of guide vanes disposed between the peripheral wall of said end bracket and the peripheral wall of said end casing for guiding the air flow from said diffuser vanes to the openings in said peripheral wall of said end bracket;

an annular mount through which the peripheral wall of said end casing is mounted to the peripheral wall of said end bracket, said annular mount having a radial wall extending between the peripheral wall of said end casing and the peripheral wall of said end bracket;

said guide vanes having their respective edges which are remote from said impeller and which abut against an inner surface of said radial wall; and said openings in said peripheral wall of said end bracket being generally rectangular in shape, said openings in said peripheral wall of said end bracket having their respective axial sides which are remote from said impeller and which are substantially flush with the inner surface of said radial wall.

19. An electric blower according to claim 1, wherein an annular space is defined between the end wall of said end bracket and the shroud plate, and the slight gap communicates the annular space with said internal space.

20. An electric blower according to claim 7, wherein said impeller includes a shroud plate defining an annular space in conjunction with the end wall of said end bracket, and the slight gap communicates the annular space with said internal space.

21. An electric blower according to claim 13, wherein said impeller includes a shroud plate defining an annular space in conjunction with the end wall of said end bracket, and the slight gap communicates the annular space with said internal space.

* * * * *